US006912886B1

(12) United States Patent
Maes

(10) Patent No.: US 6,912,886 B1
(45) Date of Patent: Jul. 5, 2005

(54) BENDING APPARATUS FOR PIPE AND TUBING

(75) Inventor: Roger V. Maes, Lakewood, CO (US)

(73) Assignee: aMAESing Tools Manufacturing, Inc., Sequim, WA (US)

( * ) Notice: Subject to any disclaimer, the term of this patent is extended or adjusted under 35 U.S.C. 154(b) by 0 days.

(21) Appl. No.: 10/809,078

(22) Filed: Mar. 24, 2004

(51) Int. Cl.[7] ..... B21D 11/04; B21D 7/02
(52) U.S. Cl. ..... 72/388; 72/217; 72/459
(58) Field of Search ..... 72/149, 154, 216, 72/217, 319, 388, 459

(56) References Cited

U.S. PATENT DOCUMENTS

| | | | | |
|---|---|---|---|---|
| 2,153,935 A | | 4/1939 | Neukirch | 153/45 |
| 2,757,562 A | * | 8/1956 | Zales et al. | 72/388 |
| 2,847,054 A | * | 8/1958 | Sutchliffe | 72/388 |
| 2,908,193 A | * | 10/1959 | Gryniewicz | 72/388 |
| 3,043,360 A | | 7/1962 | Hutchinson | 153/46 |
| 3,776,539 A | | 12/1973 | Curtis et al. | 269/81 |
| 3,901,064 A | | 8/1975 | Jacobson | 72/388 |
| 4,167,865 A | | 9/1979 | Powell | 72/217 |
| 4,785,650 A | | 11/1988 | Lusty | 72/217 |
| 4,843,861 A | | 7/1989 | Langley | 72/306 |
| 5,148,695 A | | 9/1992 | Ellis | 72/158 |
| 5,819,581 A | * | 10/1998 | Winton, III | 72/458 |
| 6,192,728 B1 | | 2/2001 | Hu | 72/149 |
| 6,457,344 B2 | * | 10/2002 | Godin | 72/458 |
| 6,463,780 B1 | * | 10/2002 | Kalanish | 72/388 |

* cited by examiner

*Primary Examiner*—David B Jones
(74) *Attorney, Agent, or Firm*—Innovation Law Group, LTD; Jacques M. Dulin, Esq.

(57) ABSTRACT

A bending apparatus is especially adapted for mounting to a vise to hold the bending apparatus in an aligned position so that the bending apparatus may impart a desired angle bend on a workpiece. The bending apparatus includes an orienting member with a cross-sectional shape to complement the shape of the vice jaws. The bending apparatus when secured in the vise jaws is oriented horizontally or vertically, thus enabling the bending apparatus to precisely create horizontal and vertical bends in a workpiece. Bends may be created in succession without requiring a user to continually adjust the orientation of the workpiece or the bending apparatus itself.

14 Claims, 7 Drawing Sheets

BENDING APPARATUS FOR PIPE AND TUBING

FIELD OF THE INVENTION

This invention relates generally to devices for bending relatively thin metal stock such as pipe and tubing, and more particularly, to a manually operable bending apparatus that is self aligning when secured in a vice.

BACKGROUND OF THE INVENTION

There are a number of devices available and especially adapted for bending pipe, tubing, and other forms of metal stock. Some of these devices are hand tools that may be manually operated to impart a bend on the stock to thereby place the stock in a desired shape and configuration. There are also a number of devices that are designed for bending more substantial pieces of stock and therefore, are table mounted or mounted to a fairly large base. These latter type of devices may be power assisted or power operated.

One example of a bending apparatus that is hand operated includes the apparatus disclosed in U.S. Pat. No. 4,167,865. This apparatus includes a base, a clamp on the base for holding portions of the metal stock to be shaped, and an elongate handle that is pivotably carried on the base and which can swivel about an axis. The handle carries a spring biased slide member having a pin constituting a shoulder adapted for engagement with the metal stock. The clamp is in the form of a vice having a fixed jaw constituted as a die, around which the metal stock is formed. The slide member is normally biased toward the pivotal axis of the handle but can yield outwardly in a direction away from such axis as the handle is swivelled. The yieldable shoulder on the handle permits the use of dies having irregular shapes.

One example of a pipe bending apparatus that is power operated for forming more substantial pieces of stock includes the apparatus disclosed in the U.S. Pat. No. 6,192,728. The device disclosed here includes a base, a material feeding device fixed on the base, an arm turning shaft fixed in front of the base, a bending mold fixed on the arm turning shaft, and a turning arm rotated by a transmitting device. The turning arm has a clamp mold fixed thereon for clamping a material pipe with help of the bending mold. The transmitting device includes a threaded rod rotated by a motor, a threaded nut mounted on the threaded rod and connected with a pull block, and an interactive device positioned between the pull block and arm turning shaft. Rotation force of the motor is converted into a linear force by means of the threaded rod and nut.

Another common type of bending device is shown in the U.S. Pat. No. 5,148,695. In this reference, the bending device is mounted on a stand or base, and the bending apparatus can be disassembled and moved to a different work site. However, even with pipe bending devices similar to the one described in this reference, such devices still require substantial effort in assembly and disassembly.

While the above described devices may be adequate for their intended purposes, there is still a need for a simple yet effective bending apparatus that is easily transportable and may be manually operated. In the construction of many commercial buildings and most homes, the great majority of piping systems installed include stock that may be bent by a hand operated bending device. Accordingly, the most common device used by pipefitters is still a hand operated pipe bender.

SUMMARY OF THE INVENTION

Therefore, it is one object of the invention to provide a hand operated bending apparatus that does not require a separate mounting pedestal or base, and is especially adapted for mounting to an existing vise used at a work site.

It is yet another object of the invention to provide a manually operated bending apparatus that is self-aligning whereby precise horizontal and vertical bends can be accomplished without the user having to use additional effort in aligning the workpiece to achieve a desired bend.

It is yet another object of the invention to provide a bending apparatus that is of simple construction, yet is extremely reliable in allowing a user to efficiently configure workpieces for installation into a piping system.

It is yet another object of the invention to provide a combination of an existing vise and a bending apparatus to achieve bending of stock thereby eliminating more complex tools or machines that are normally used for bending stock.

The present invention is directed to a hand operable bending apparatus that may be used for bending relatively thin walled stock directly at the job site. The apparatus is mounted to an existing vise used at the job site to secure stock to be installed into a pipe or tubing system. The bending apparatus includes a base member which carries a die for shaping the stock when a bending handle of the device is traversed through an arc thereby imparting a particular bend angle on the stock. The base includes an orienting block or member that is secured in the vise. The orienting member has a shape which complements the shape of the surfaces on the vise that contact the orienting member. A vise typically has a stationary jaw and a movable jaw which is movable to and away from the stationary jaw for securing the workpiece. Accordingly, the orienting member has a shape which complements the particular configuration of the vise so that the orienting member is rigidly held within the vise. The shape of the orienting member is also configured so that the bending apparatus is aligned to produce precise horizontal or vertical bends. Thus, a user of the tool can easily make a desired vertical or horizontal bend without having to realign the workpiece after it is secured in the bending apparatus, and otherwise does not have to exert additional effort in aligning the workpiece to achieve a desired bend.

DETAILED DESCRIPTION

Figure 1:
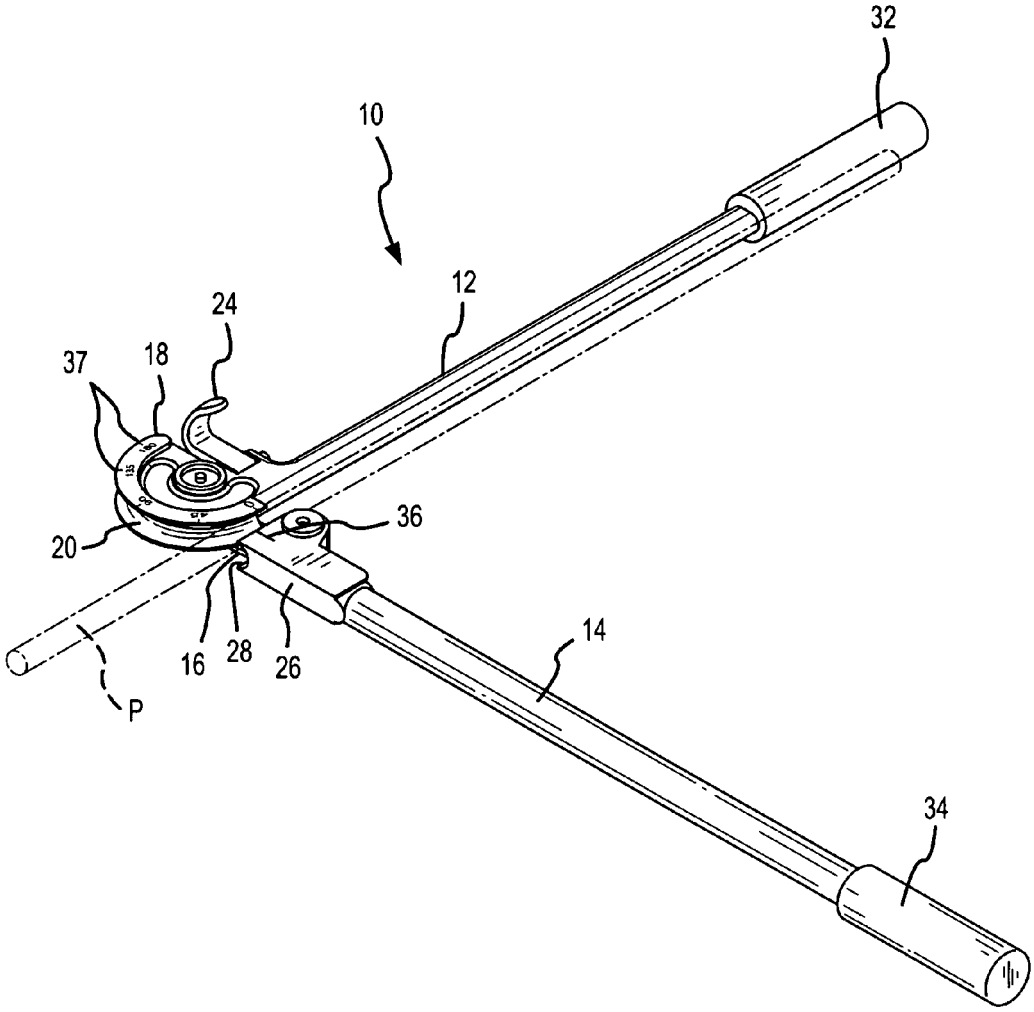
PRIOR ART FIG.1
FIG. 1 is a perspective view of a prior art bending apparatus that is hand or manually operated.

FIG. 1 illustrates a prior art hand operated bending apparatus 10. The apparatus 10 includes a first handle member or support 12, a second bending handle 14, and a connecting plate or member 16 that is at least pivotally mounted to the first handle member 12 thereby enabling the second handle member 14 to be rotated about the first handle member. Carried on the first handle or support 12 is an arcuate shaped die 18 having a channel 20 formed therein. The channel receives the workpiece to be bent. The channel may be sized to receive a particular diameter of stock, and it is also known to provide a plurality of stacked dies mounted to the support 12 thereby allowing the apparatus to manipulate different sized pieces of stock. Preferably, the connecting member 16 is also pivotally mounted to the second bending handle thereby allowing an operator to selectively position the engaging portion 26 of the handle 14 a desired distance from the channel 20, thereby also accommodating workpieces of different diameters. Engaging portion 26 has a channel 28 that makes contact with the stock during bending. Channels 20 and 28 complement one another to form an enclosure around the workpiece during bending thereby ensuring there are no crimps created during the bending. Handle grips 32 and 34 may be attached to the respective handles. When a user desires to bend the workpiece such as a length of tubing or pipe P, the locking member 24 is rotated to engage the workpiece. The locking member prevents movement or rotation of the pipe. The user then rotates the second handle 14 through an arc to impart a bend on the pipe. An index mark 36 may be placed on the engaging portion to enable the user to measure the degree of bend that has been imparted on the pipe as the second handle is rotated. Accordingly, degree markings 37 may be placed on the exposed face of die 18 indicating the degree to which the pipe has been bent by aligning the index mark with the desired degree mark.

One problem associated with the apparatus shown in FIG. 1 is that the operator must use both hands to operate the device, and achieving a precise bend angle in thicker pieces of stock becomes more difficult due to the additional force required to make the bend. Another problem that is encountered with the apparatus is if a subsequent bend needs to be made in the stock, particularly if the subsequent bend must be made so that the stock is bent in a different plane, then it is very difficult for the user to reorient the stock to be held by the locking member 24 and then maintain the workpiece in the precise plane. For hand operated pipe benders like that shown in FIG. 1, pipefitters often choose to use a bending apparatus that includes its own mounting pedestal, thereby increasing the size and complexity of the tool. Additionally, for particularly long runs of tubing or pipe that must be bent in multiple planes, a hand operated bending apparatus becomes infeasible and a pipefitter must rely on a bending tool having its own pedestal.

Figure 2:
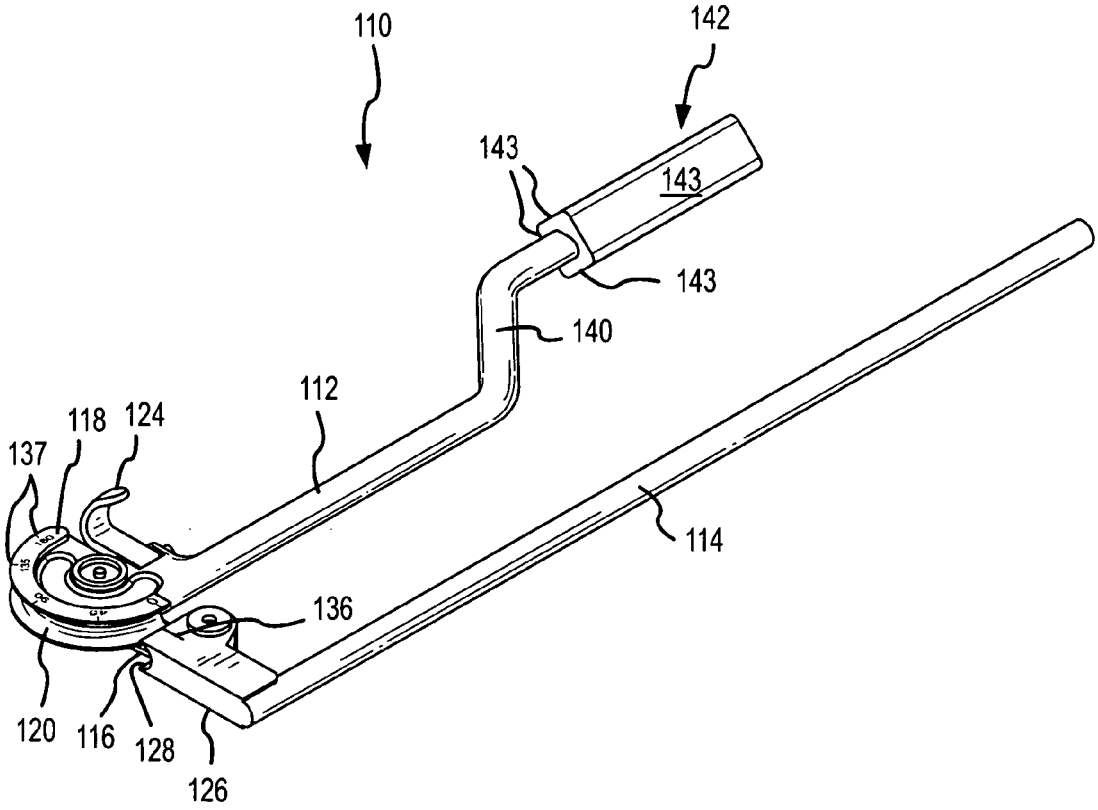
FIG. 2 is a perspective view of the bending apparatus of the present invention.
Figure 3:
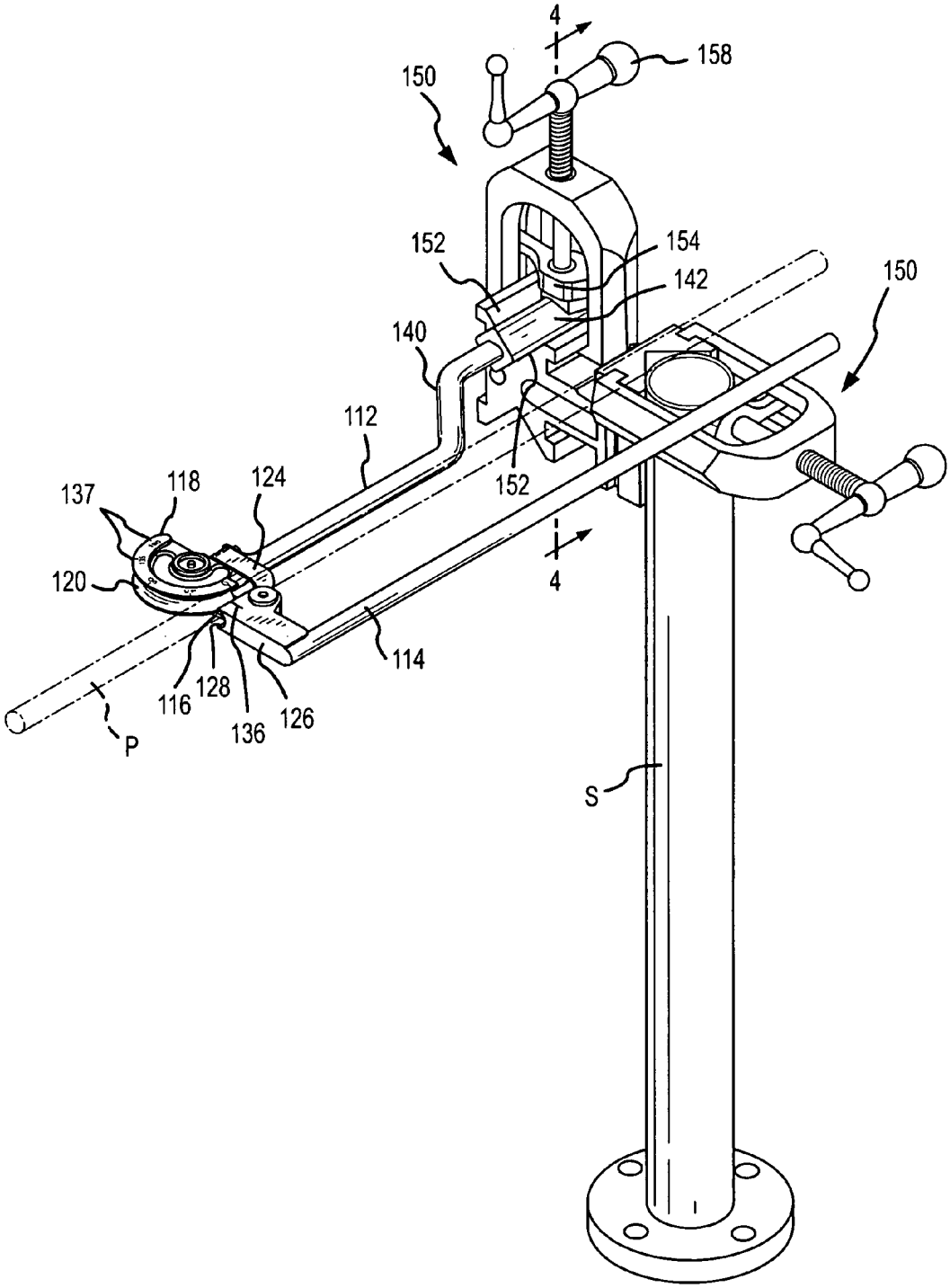
FIG. 3 is a perspective view of the bending apparatus of the present invention mounted within an existing vise installed at a job site.

Referring to FIG. 2, the bending apparatus 110 of the present invention is illustrated. Apparatus 110 includes a support extension or handle 112, a bending handle 114, and a connecting member or plate 116 that is at least pivotally mounted to the support 112. An arcuate die 118 is incorporated on the support 112, and includes a channel 120 which receives the workpiece to be manipulated. The support 112 further includes a locking member 124 that may be rotated between a disengaged position as shown in FIG. 2, to a locked or engaged position as shown in FIG. 3 to secure a workpiece to be bent. The bending handle 114 further includes an engaging portion 126 having an arcuate engaging surface or channel 128 that contacts the workpiece during bending. The bending handle 114 may extend perpendicular or orthogonally with respect to the channel 128 of engaging portion 126. Optionally, a handle grip (not shown) may also be incorporated on the free end of the handle 114. An index mark 136 may be placed on the engaging portion 126 thereby providing the user with an indication as to the degree to which the workpiece has been bent by aligning the mark 136 with the corresponding degree marking 137. An offset section 140 connects to the support 112. An orienting member or block 142 attaches to the offset section 140. The orienting member 142 has a square shaped cross-section that matches or complements the shape of the jaws of a vise, as discussed further below.

Now referring to FIG. 3, the bending apparatus 110 is shown with the orienting block 142 secured in a vise 150. The particular vise 150 shown in FIG. 3 corresponds to the vise disclosed in my copending patent application Ser. No. 10/773,781 filed on Feb. 6, 2004, this application being hereby incorporated by reference herein. The vise 150 includes a stationary jaw having a pair of v-shaped engaging surfaces 152, and a movable jaw assembly 154 having a pair of v-shaped or arcuate engaging surfaces 156. The handle 158 of the vise is operated to lower the movable jaw so that the orienting block 142 is secured between engaging surfaces 152 and 156. Typically, the vise 150 is mounted to an existing stanchion S, handrail or other type of support which supports one or more pipe members of a pipe system. The vise 150 is arranged such that a straight section of pipe or tubing that is secured within the vise will extend horizontally with respect to the ground. The vise 150 may be mounted as shown either to a vertically extending support, or a horizontally extending support.

Figure 4:
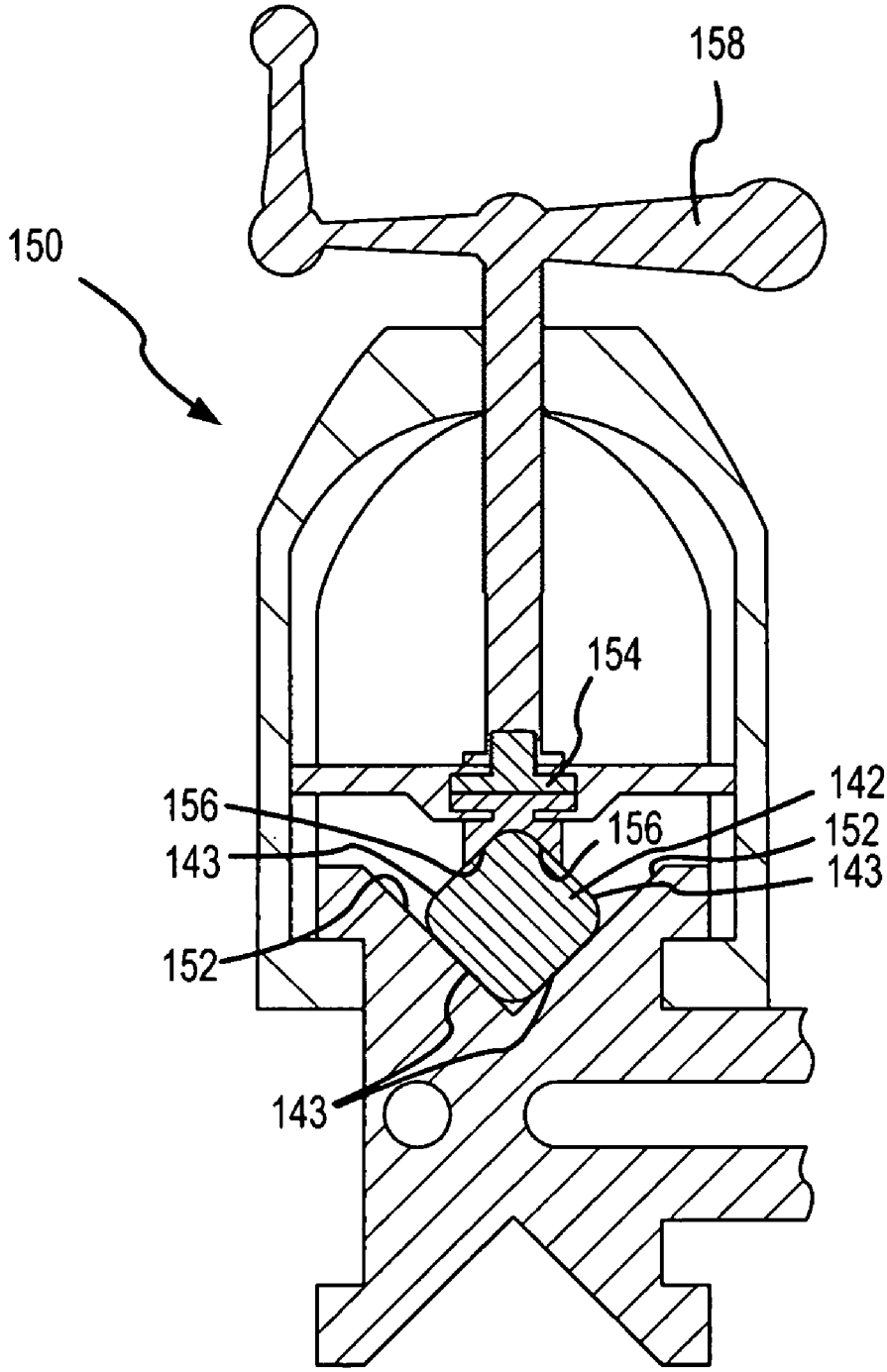
FIG. 4 is an enlarged cross-section taken along line 4—4 of FIG. 3.

As shown in the enlarged FIG. 4, the stationary jaw having the v-shaped engaging surfaces 152 contacts the adjacent v-shaped exterior surfaces 143 of the orienting member 142. When looking at FIG. 4 in cross-section, the orienting member 142 has an opposing pair of v-shaped exterior surfaces 143 thereby giving the orienting member 142 a generally square cross sectional shape. The v-shaped or arcuate engaging surfaces 156 of the movable jaw assembly need not be an exact complementary shape for contacting the surfaces 143 so long as there is at least some curvature in the surfaces 156 to increase the surface area in contact with the surfaces 143. Thus, the vise 150 can adequately secure the orienting member so that it will not rotate or otherwise shift during use.

The configuration of the orienting member with respect to the support handle 112 ensures that when the orienting member is secured in the vise, the channel 120 extends in a plane parallel with the ground. Accordingly, any workpiece that is bent will also be bent in a horizontal plane parallel to the ground.

Although the orienting member 142 is shown as having a square or rectangular cross-sectional shape, it shall be understood that the invention can be adapted to complement the particular shape of the jaws of the vise. For example, the upper or movable jaw of a vise may have a flat jaw surface, or at least a less arcuate or v-shaped engaging surface. In such a case, it may be necessary to provide an insert (not shown) that is placed between the upper jaw and the orienting member so that increased frictional resistance would be provided by contact of the upper jaw. For example, the insert may have one surface that is v-shaped or arcuate to match the shape of the orienting member, and the upper surface of the insert could complement the particular shape of the upper jaw. This insert, if placed between the upper jaw and the orienting member would thereby increase the surface area in contact with the orienting member, thereby better stabilizing the orienting member within the vise.

A workpiece or stock such as a section of pipe P is placed between the die and engaging surface of the apparatus, and the locking member 124 is rotated to secure the pipe P. The user may then rotate the bending handle 114 to impart the desired bend on the pipe. This bend will be precisely aligned horizontally, thereby easing the manner in which such a horizontal bend can be made without having to separately align or orient the section of pipe as by a leveling device.

Figure 5:
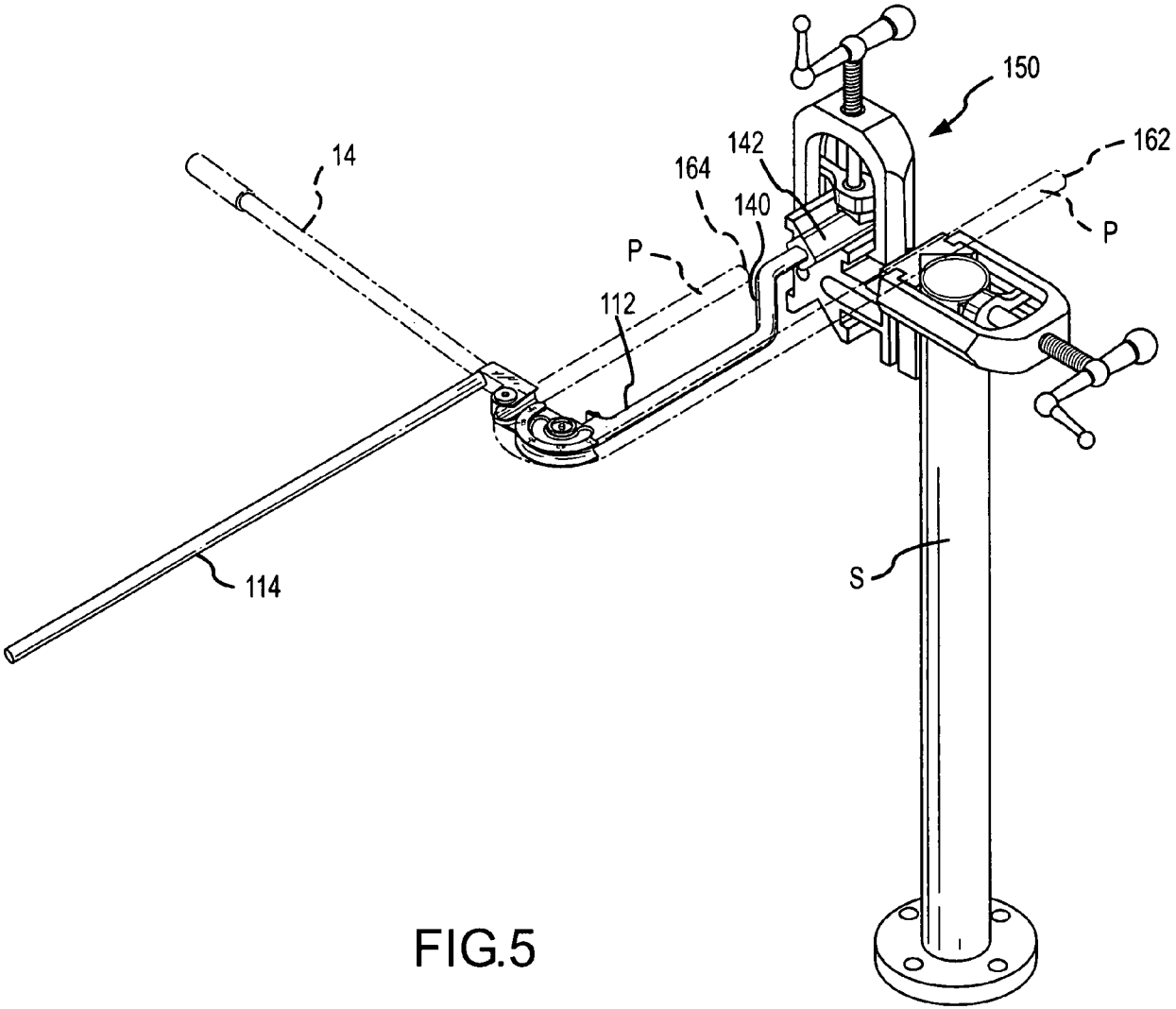
FIG. 5 is another perspective view of the bending apparatus of the present invention that has performed a bending operation on a workpiece.

FIG. 5 illustrates a 180° bend made by the bending apparatus. The offset section 140 provides necessary separation between the vise and the first end 162 of the pipe so that the pipe P can extend to both sides of the vise without being be interfered with by the vise. Additionally, the first end 162 of the pipe may already be connected to the pipe system and therefore, this end may not be able to be moved to accommodate the location of the vise. Thus, the offset 140 allows the bending apparatus to be used to bend partially installed sections of pipe.

FIG. 5 also illustrates the position that the bending handle 14 of the prior art device would be found if a 180° bend had been imparted on the stock. With the orientation of the bending handle 114 of the present invention, bends up to 180° may be performed without the bending handle being positioned so that upon completion of the bend, the bending handle would substantially extend beyond a longitudinal axis parallel to the axis of the stock being bent. Thus, the apparatus of the present invention is more conducive to use within small confined spaces which are commonly found in many pipe systems.

Figure 6:
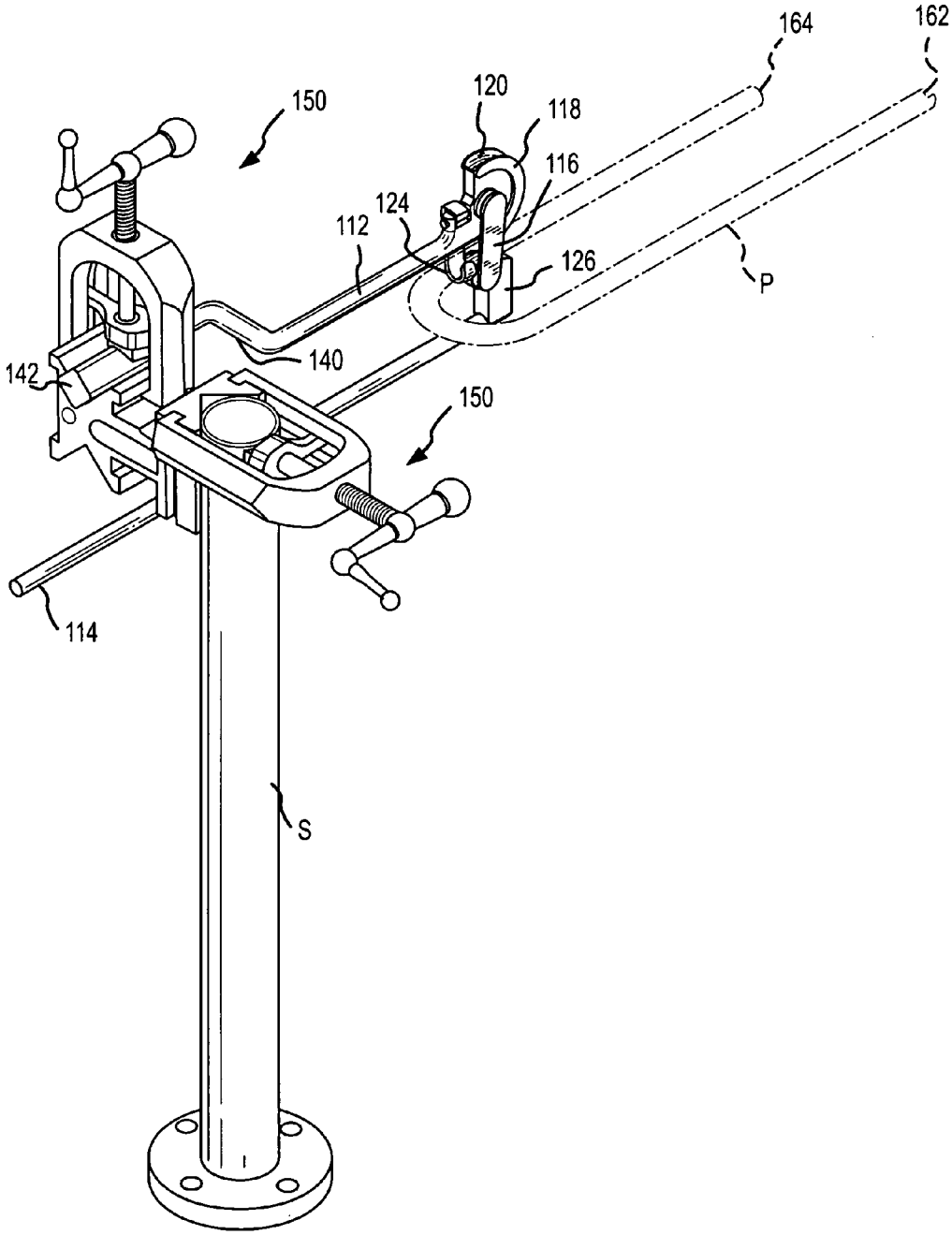
FIG. 6 is another perspective view of the bending apparatus of the present invention wherein the bending apparatus has been remounted in the vise enabling the bending apparatus to perform a subsequent bend on the workpiece at a 90° angle with respect to the first bend performed on the workpiece.

FIG. 6 illustrates the bending apparatus re-mounted within the vise so that the bending apparatus may make a subsequent bend on the section of pipe that is both at a 90° angle to the first bend and perpendicular to the plane of the first bend. To create this second bend, the bending apparatus is released from the vise, and the bending apparatus is rotated 90° so that the vise secures the orienting block 142 in the perpendicular arrangement as shown. Accordingly, the channel 120 extends in a plane perpendicular to the ground.

Figure 7:
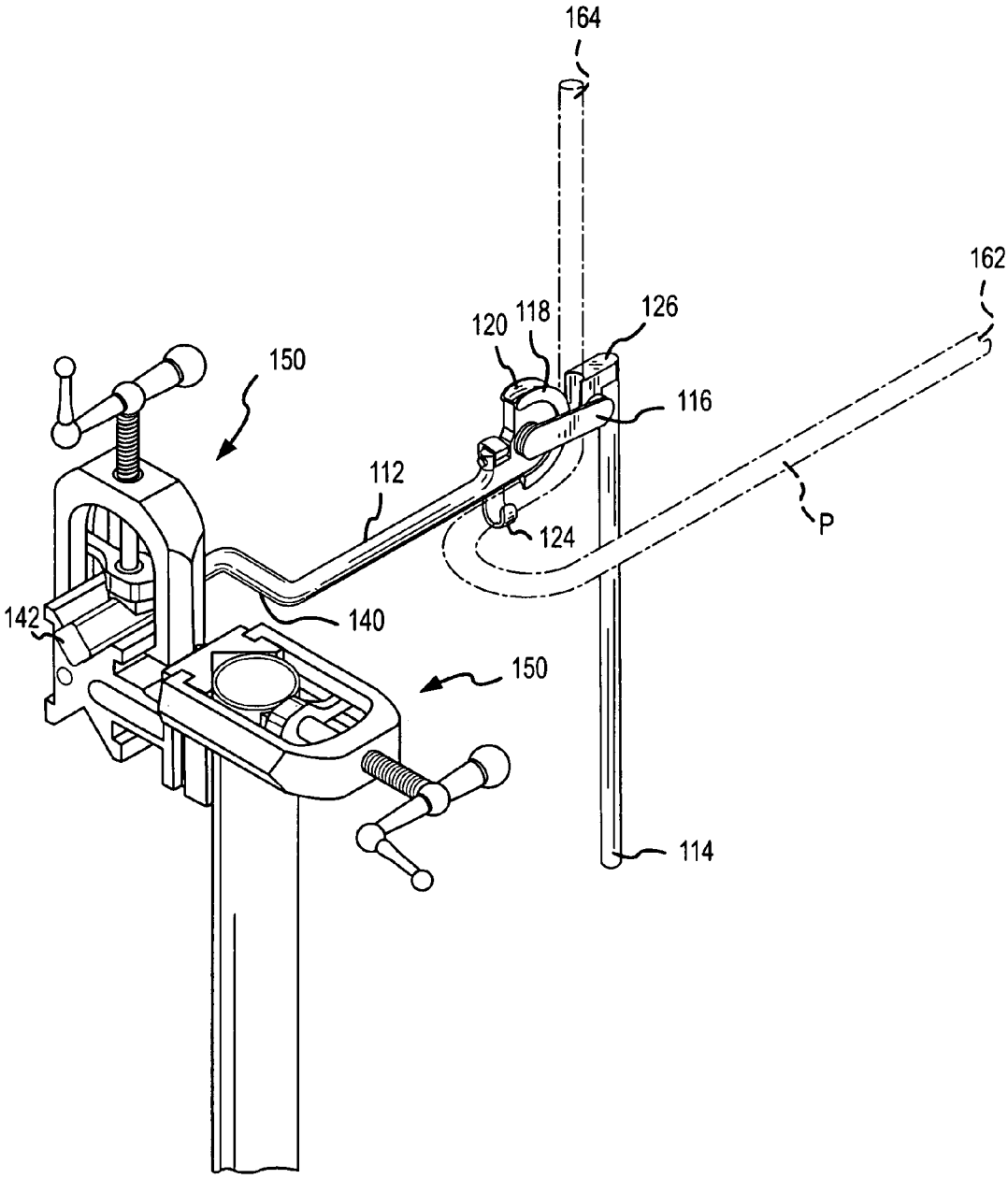
FIG. 7 is another perspective view of the bending apparatus of the present invention showing the subsequent bend made by the apparatus.

As shown in FIG. 7, the bending handle of the apparatus is operated to impart the second or subsequent bend on the pipe that is 90° from and out of plane with respect to the first bend. This subsequent bend is precisely aligned at 90° and perpendicularly out of plane with the first bend without the user having to provide another vise to secure the pipe to create the subsequent bend. More specifically, once the user has remounted the bending apparatus in its rotated position within the vise, the user would first level the length of pipe as by a standard leveling device (not shown), and then rotate the locking member 124 to secure the pipe. Then, the subsequent bend can be accomplished without further alignment or manipulation of the pipe.

In the event the length of pipe is already mounted to the piping system so the first end 162 of the pipe is stationary and cannot be moved, and a subsequent vertical or horizontal bend is required to be made at the second end 164 of the pipe, then the user still has a number of options to create the second bend. One option is to simply remount the bending apparatus to a vise which is secured to another stanchion S, handrail, or another support. Accordingly, the vise shown in FIG. 6 could be considered mounted to another stanchion S that was spaced from the original stanchion. Alternatively, the vise could be mounted to a dedicated and portable support which could be moved from place to place at the job site. Such a support could simply be a vertical member with its lower end secured to a base.

The advantages of the present invention are apparent. A hand operated bending apparatus provides a user with the capability to make horizontal and vertical bends, without having to rely upon a larger, more complex bending apparatus that is typically found with current prior art devices. The orienting block of the invention is especially adapted to mount within a vise which is used to support other sections of pipe directly at the job site. Accordingly, the bending apparatus does not require a separate or dedicated base support. The orienting block, because it can be precisely aligned with the jaws of the vise, allows horizontal and vertical bends to be made with precision thereby simplifying the work of a user in aligning the workpiece. The position of the bending handle with respect to the die is such that the bending handle is rotated through an arc that better avoids potential interference with surrounding pipes or the vise itself.

While the present invention has been described with respect to a preferred embodiment, it shall be understood that various changes and modifications may be made within the spirit and scope of the invention as defined in the appended claims.

What is claimed is:

1. A bending apparatus for forming curved bends in a workpiece comprising:

a) a longitudinally extending support handle having first and second end portions, a lateral offset section spanning between said end portions, each said portion having a longitudinal extent and a longitudinal axis, and said longitudinal axes are disposed parallel to each other;

b) a bending handle having an engaging portion;

c) a die incorporated on said first end portion of said support handle and having a curved bending channel formed therein, said curved bending channel defining a bending plane;

d) a connecting member having first and second ends, said first end being pivotally attached to said support handle first end portion, and said second end attached to said bending handle; and e) an orienting member attached to said second end portion of said support handle, said orienting member having a square cross-sectional shape with axes orthogonal to the side faces of said square, said axes being oriented 45° to said bending plane so that sequential bends oriented in planes at substantially precise orthogonal relationship to each other can be made by alternately clamping adjacent sides of said square orienting member in a fixed position during bending.

2. An apparatus, as claimed in claim 1, wherein;

said second end of said connecting member is pivotally attached to said bending handle.

3. An apparatus, as claimed in claim 1, wherein;

said die includes gradations formed thereon corresponding to the angles to which said workpiece can be bent by the bending apparatus, and said bending handle has an index incorporated thereon to determine the angular amount of bend imparted by the bending handle on the workpiece.

4. An apparatus, as claimed in claim 1, wherein:

a) said axis of said second end portion of said support handle on which said orienting member is mounted lies in said bending plane.

5. An apparatus, as claimed in claim 1, wherein:

a) said engaging portion of said bending handle is offset from said handle, and the axis of said bending handle lies in said bending plane.

6. In combination, a vise and bending apparatus for forming curved bends in a workpiece comprising:

a) a longitudinal extending support handle having first and second end portions, a lateral offset section spanning between said end portions, each said portion having a longitudinal extent and a longitudinal axis, and said longitudinal axes are disposed parallel to each other;

b) a bending handle having an engaging portion;

c) a die incorporated on said first end portion of said support handle and having a curved bending channel formed therein, said curved bending channel defining a bending plane;

d) a connecting member having first and second ends, said first end being pivotally attached to said support handle first end portion, and said second end attached to said bending handle;

e) an orienting member attached to said second end portion of said support handle, said orienting member having a square cross-sectional shape with axes orthogonal to the side faces of said square, said axes being oriented 45° to said bending plane so that sequential bends oriented in planes at substantially precise orthogonal relationship to each other can be made by alternately clamping adjacent sides of said square orienting member in a fixed position during bending; and f) a vise having a stationary jaw, and a movable jaw movable toward and away from said stationary jaw, said jaws being V-shaped, opposed and oriented so that said square cross-sectional shape of said orienting member complements and is received in the gap between said jaws, and wherein said orienting member attaches to said support in only selected orthogonal orientations so that said bending apparatus may create horizontal or vertical bends in a workpiece without readjusting said bending apparatus when secured to the vise said bends being at substantially precise orthogonal relationship to each other when said orienting member or said workpiece is rotated 90° between bending operations.

7. An apparatus, as claimed in claim 6, wherein;

said second end of said connecting member is pivotally attached to said bending handle.

8. An apparatus, as claimed in claim 6, wherein:

said die includes gradations formed thereon corresponding to the angles to which said workpiece can be bent by the bending apparatus, and said bending handle has an index incorporated thereon to determine the angular amount of bend imparted by the bending handle on the workpiece.

9. An apparatus, as claimed in claim 6, wherein:

a) said axis of said second end portion of said support handle on which said orienting member is mounted lies in said bending plane.

10. An apparatus as claimed in claim 6, wherein:

a) said engaging portion of said bending handle is offset from said handle, and the axis of said bending handle lies in said bending plane.

11. A method of bending a workpiece, said method comprising the steps of:

a) providing a bonding apparatus comprising:

i) a support;

ii) a bending handle having an engaging portion;

iii) a connecting member having first and second ends, said first end being pivotally attached to said support, and said second end attached to said bending handle;

iv) a die incorporated on said support and having a curved bending channel formed therein, said curved die channel defining a bending plane; and v) an orienting member attached to said support, said orienting member having a square cross-sectional shape with axes orthogonal to the side faces of said square, said axes being oriented 45° to said bending plane so that sequential bends oriented in planes at substantially precise orthogonal relationship to each other can be made by alternately clamping adjacent sides of said square orienting member in a fixed position during bending;

b) attaching the bending apparatus to a securing device wherein said orienting member orients said bending apparatus to a desired orientation selected from one of two orientations orthogonal to each other;

c) securing a workpiece to be bent in the bending apparatus; and d) operating the bending handle to impart a desired first angular bend on the workpiece wherein the workpiece remains oriented in one of said orthogonal orientations with respect to the ground.

12. A method, as claimed in claim 11, further including the steps of:

a) releasing the workpiece from the securing device;

b) rotating the bending apparatus with respect to the securing device to orient the bending apparatus to said second orthogonal orientation substantially 90° from its original position in the securing device;

c) resecuring the bending apparatus in the securing device;

d) repositioning the workpiece in the bending apparatus; and e) operating the bending handle to impart a desired second angular bend on the workpiece, said second angular bend being in a plane oriented substantially 90° from the plane of the first angular bend.

13. A bending apparatus comprising:

a) a support having first and second ends, said first end having a curved bending channel defining a bending plane formed thereon for receiving a workpiece;

b) a bending handle having an engaging portion;

c) a connecting member having first and second ends, said first end being pivotally attached to said support, and said second end being attached to said bending handle; and d) means attached to said second end of said support for orienting said bending apparatus allowing said bending apparatus to produce a desired angular bend in the workpiece, said orienting means having a square cross-sectional shape with axes orthogonal to the side faces of said square, said axes being oriented 45° to said bending plane so that sequential bends oriented in planes at substantially precise orthogonal relationship to each other can be simply by alternately clamping adjacent sides of said square orienting member in a fixed position during bending.

14. In combination, a securing device and being apparatus comprising:

a) a support having first and second ends, said first end having a curved bending channel defining a bending plane formed thereon for receiving a workpiece;

b) a bending handle having a workpiece-engaging portion;

c) a connecting member having first and second ends, said first end being pivotally attached to said support, and said second end being attached to said bending handle;

d) means attached to said second end of said support for orienting said bending apparatus allowing said bending apparatus to produce a desired angular bend in the workpiece, said orienting means having a square cross-sectional shape with axes orthogonal to the side faces of said square, said axes being oriented 45° to said bending plane so that sequential bends oriented in planes at substantially precise orthogonal relationship to each other can be made by alternately clamping adjacent sides of said square orienting member in a fixed position during bending; and e) a securing device having at least two opposing engaging surfaces defining a gap between, one of said engaging surfaces being movable to and away from the other of said engaging surfaces, wherein said square cross-sectional shape of said means for orienting complements said gap between said engaging surfaces for selectively retaining said orienting means in either of said orthogonal orientations for bending said workpiece.

* * * * *